United States Patent [19]

Shevakin et al.

[11] 4,034,590

[45] July 12, 1977

[54] BILLET-STORAGE DEVICE FOR DRAWBENCHES

[76] Inventors: Jury Fedorovich Shevakin, Telegrafny pereulok, 11/16, kv. 53; Pavel Vasilievich Bashilov, Profsojuznaya ulitsa, 106/47, kv. 29; Igor Iosifovich Dobkin, 2 Avtozavodsky proezd, 5, korpus 1, kv. 6, all of Moscow; Mikhail Iosifovich Temkin, ulitsa Lenina, 9, kv. 46; Lev Borisovich Kuznetsov, ulitsa Lenina, 4, kv. 8, both of Kolchugino Vladimirskoi oblasti; Vitaly Vyacheslavovich Kotov, Raketny bulvar, 9, korpus 2, kv. 133; Fikrat Seidaliogly Seidaliev, ulitsa Golovacheva, 17, kv. 125, both of Moscow; Efim Moiseevich Donskoi, ulitsa Mayakovskogo, 4, kv. 6, Elektrostal Moskovskoi oblasti; Valentin Vasilievich Belkin, ulitsa Kakhovka, 23, korpus, 2, kv. 101, Moscow; Evgeny Fedorovich Prutkin, ulitsa Lenina, 52, korpus 2 kv. 71, Sverdlovsk, all of U.S.S.R.

[21] Appl. No.: 623,553

[22] Filed: Oct. 17, 1975

[51] Int. Cl.[2] ..... B21C 1/10

[52] U.S. Cl. ..... 72/280; 72/289; 242/47.12

[58] Field of Search ..... 72/289, 280, 281; 242/47.12; 226/117

[56] References Cited

U.S. PATENT DOCUMENTS

| | | | |
|---|---|---|---|
| 2,024,768 | 12/1935 | Johnson | 72/280 X |
| 2,996,170 | 8/1961 | Bruestle | 72/289 X |
| 3,241,780 | 3/1966 | Kitselman | 72/280 X |

*Primary Examiner*—Frank T. Yost
*Attorney, Agent, or Firm*—Lackenbach, Lilling & Siegel

[57] ABSTRACT

A storage device comprising two blocks of different diameter with parallel axes and bases arranged at right angles to the axes. The blocks are set up with an eccentricity with respect to each other, the relative displacement of their axes being equal to half the difference between the diameters of the block bases presented to each other, the smaller diameter block having a possibility of running about the axis of the larger diameter block in both directions, therefore, by such means the billet can be transferred from the larger to the smaller diameter block with a smaller extent and number of bends when compared to the known storage device, thus allowing continuous drawing of tubes by joining and welding the billets end to end.

2 Claims, 7 Drawing Figures

BILLET-STORAGE DEVICE FOR DRAWBENCHES

The present invention relates to the production of metal articles by drawing and more particularly to billet-storage devices for drawbenches adapted to provide continuous drawing.

To allow continuous drawing billet ends must be joined by butt-welding without stopping a drawbench.

However, with the storage devices employed on modern drawbenches continuous drawing becomes possible only when drawing wire. As for the possibility of using the known storage devices in drawing tubes, they fail to provide continuous drawing, since in this case the drawbenches must be stopped to enable the tubes to be joined.

Known in the art is a billet-storage device for a drawbench avoiding the twist in the billet in service. The prior-art storage device comprises a pulling block which is rotated by a constant-speed drive. It also incorporates a standby block of a smaller diameter axially aligned with the first block and running freely. The bases of these blocks are arranged at right angles to their axes. Disposed intermediate of the blocks is a guide roller fixed on a planetary carrier that is linked mechanically through a sun-and-planet gear with both the pulling and standby blocks. When the pulling block is running, wire is reeled thereon slipping off from its top edge over the guide roller to the standby block. The gear ratio of the sun-and-planet gear is selected so that when the pulling and standby blocks are set to run at the same peripheral speed, the planetary carrier is at rest.

If the peripheral speed of the standby block is lower than that of the pulling block, the planetary carrier moves in such a direction that the wire transfer from the pulling to the standby block decelerates, the wire collecting on the pulling block. At an inverse speed ratio the turns accumulated on the pulling block are drawn therefrom.

The use of the known billet-storage device does not allow continuous drawing of tubes, insofar as a tubular billet is subjected to a large number of bends having a considerable extent and resulting in its hardening and, hence, in a deterioration of plastic properties of the billet metal which may produce potential deformation and adversely affect the quality of a finished tube or preclude completely its drawing.

Thus, owing to the above disadvantages the application of the known billet-storage devices for developing continuous tube drawbenches using the reeling technique is absolutely impractical.

An object of the present invention is the provision of a billet-storage device for a drawbench whose application would allow decreasing the extent and the number of bends in the billet during drawing and also permit continuous drawing of tubes by the reeling technique.

Said object and other objects are achieved by providing a billet-storage device for drawbenches, which avoids the twist in the billet in operation, comprising two blocks of different diameter having parallel axes and mounted on a housing so that their bases, that are normal to their axes, are presented to one another, and a device for directing the billet which is transferred from a larger-to a smaller diameter block, the billet being uncoiled from the smaller diameter block by a succeeding draw block. According to the invention, for transferring the billet from the larger to the smaller diameter block the blocks are set up with an eccentricity, the relative displacement of their axes being equal to half the difference between the diameters of their bases presented to each other, and the smaller diameter block is provided with a possibility of running about the axis of the larger-diameter block in both directions.

To enable rotation of the smaller diameter block about the axis of the larger diameter block a drive eccentric shaft is preferably mounted inside the blocks which must have a possibility of running freely about the shaft.

It is also expendient that the device for directing the billet while it is transferred from the larger to the smaller diameter block be made as a roller guide arranged between the blocks and fixed on the secion of the eccentric shaft that is axially aligned with the larger diameter block.

The essence of the present invention is, thus, the provision of a billet-storage device for a drawbench whose application will decrease the extent and the number of bends in the billet, which would allow continuous drawing of tubes by the reeling technique.

The nature of the invention will be clear from the following detailed description of a particular embodiment to be had in conjunction with the accompanying drawings, in which.

Figure 1:
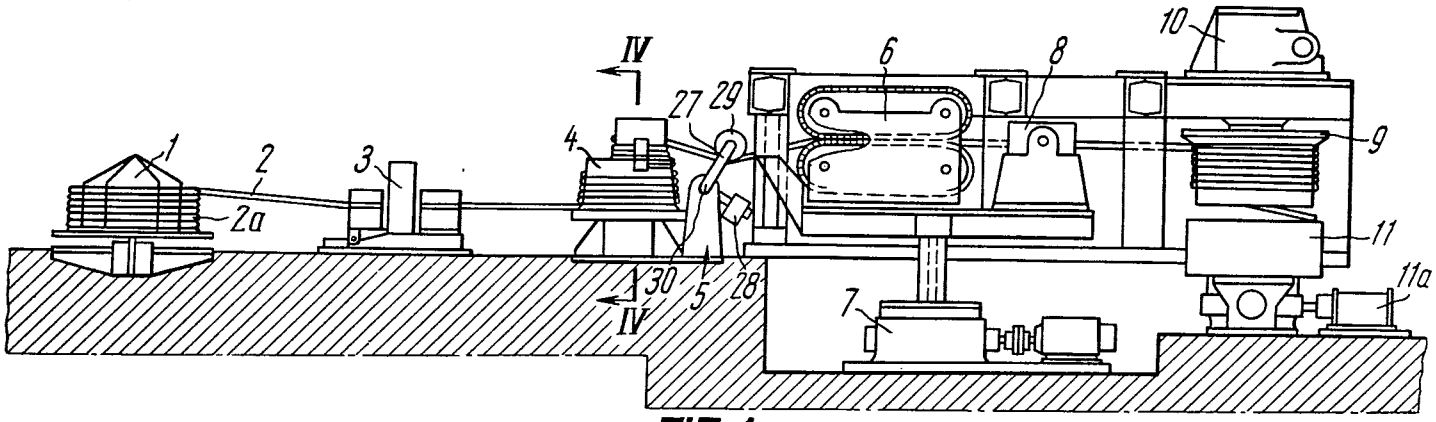
FIG. 1 is a side view partially in section of a drawbench using a billet-storage device, according to the invention.
Figure 2:
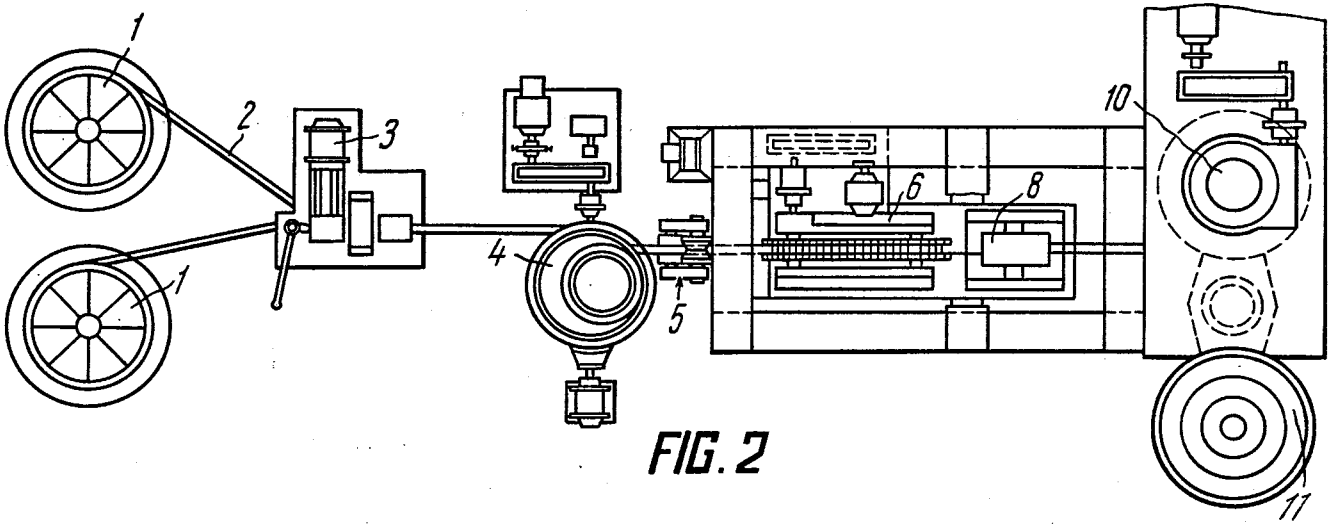
FIG. 2 is a top plan view.

In the drawings FIGS. 1 and 2 show a drawbench comprising two floor reels 1 on which are placed coils of billets 2 to be drawn; a butt-welding machine 3 adapted for welding billets end to end; a billet-storage device 4 which allows continuous drawing when the rear (in the direction of motion) end of the billet is stopped; a billet tension controller 5 feeding the billet into a die at a constant speed; a pusher 6 with a drive 7 providing the threading-up and pushing of the front end of the first billet into a die 8 wherein the billet is subjected to plastic deformation; a draw block 9 with a drive 10 providing a drawing force required to draw the billet through the die, and a receiving device 11 with a drive **11*a*** adapted for receiving and handling a finished article.

Figure 3:
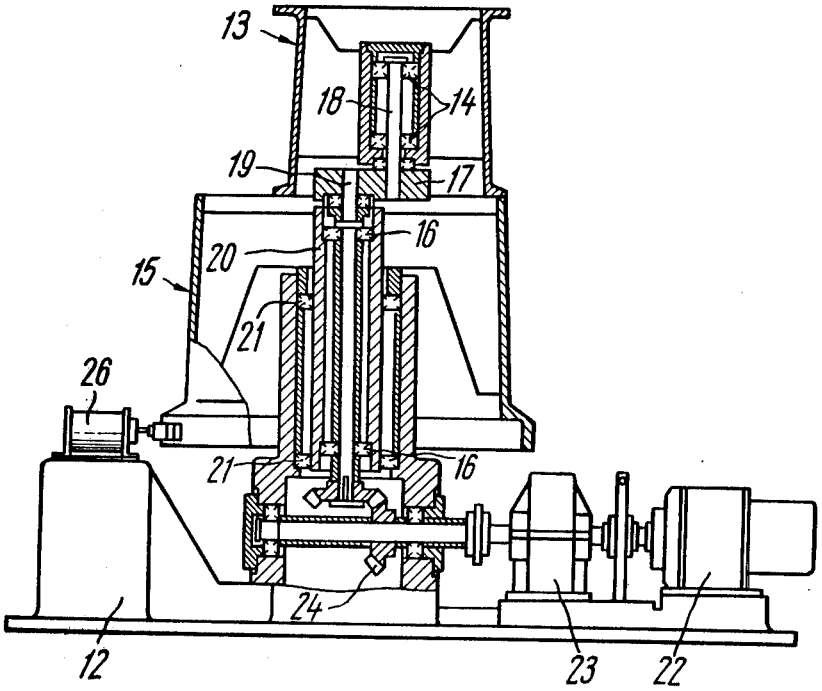
FIG. 3 is an end view partially in section of a billet-storage device, according to the invention.
Figure 4:
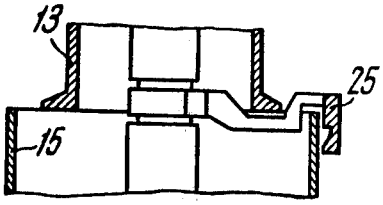
FIG. 4 is a cross sectional view taken along the line IV—IV of FIG. 1.
Figure 5:
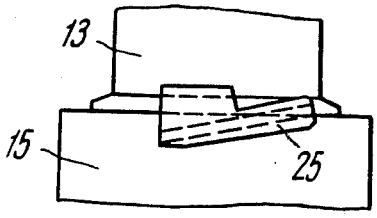
FIG. 5 is a side view of a device for directing the billet when it is being transferred from a larger to a smaller diameter block.
Figure 6:
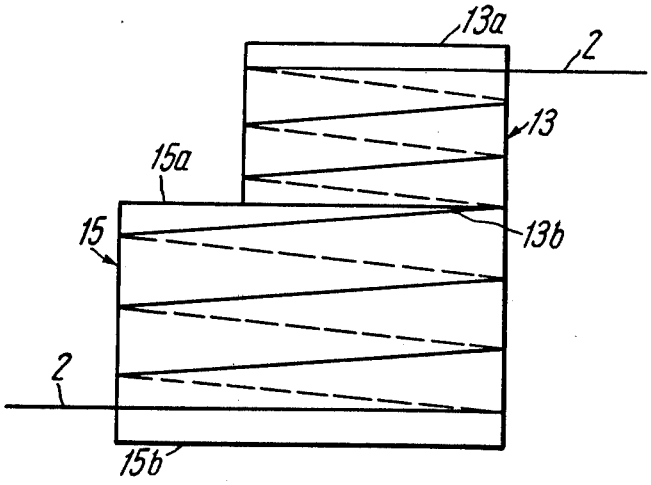
FIG. 6 is a schematic drawing as seen from the side illustrating the operation of the billet-storage device.
Figure 7:
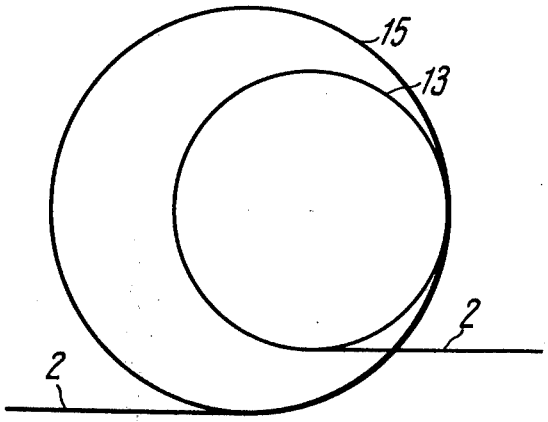
FIG. 7 is a schematic drawing as seen from the top illustrating the operation of the billet-storage device.

The billet-storage device 4 for a drawbench presented in FIGS. 3, 4 and 5 incorporates a smaller diameter block 13 mounted on rolling supports 14 and a larger diameter block 15, said blocks 13 and 15 being set up on a housing 12 and enclosing an eccentric shaft 17, running in bearings 16 and housing a spindle 18 of the smaller diameter block and a spindle 19 of the larger-diameter block 15, both spindles 18 and 19 being parallel to each other, with the top base **13*a* (FIGS. 6, 7) and the bottom base 13*b* of the block 13, as well as the top base 15*a* and the bottom base 15*b* of the block 15, being disposed at right angles to the block spindles. The relative displacement of the block spindles is equal to half the difference between the diameters of the bases 13***b* and 15*a* presented to each other. The smaller diameter block 13 is mounted rotatably in both directions about the spindle of the larger diameter block 15. Owing to the above design of the billet-storage device with the blocks occupying any relative position during the rotation of the smaller diameter block about the spindle of the larger diameter block, the peripheral points on the block bases presented to each other are located on the coinciding generatrices of the block surfaces, a feature enabling a stepless transfer of the tubular billet from the larger to the smaller diameter block.

A hub 20 of the larger diameter block 15 is mounted in the housing 12 in bearings 21. The eccentric shaft 17 is coupled through a pair of bevel gears 24 to a drive, which comprises an electric motor 22 and a reducer 23 and is fitted with the device for directing the billet which is made as a roller guide 25 (FIGS. 4, 5) arranged intermediate of the blocks 13 and 15 and fixed on the section of the eccentric shaft 17 aligned axially with the larger diameter block 15. The latter (larger diameter block 15) is provided with a brake 26.

It is clear that to enable the rotation of the smaller diameter block 13 about the axis of the larger diameter block 15 any gear may be used in addition to the eccentric shaft 17.

A drawbench equipped with the herein-proposed billet-storage device operates in the following manner.

A coiled tubular billet 2 is placed on one of the floor reels 1 (FIGS. 1, 2) and is then drawn through the butt-welding machine 3.

The number of turns needed to ensure the continuity of the drawing process is built up on the larger diameter block 15 of the billet-storage device 4.

Next the billet is fed with the aid of the roller guide 25 to the smaller diameter block 13 on which one or two turns are wound, whereupon the billet end is passed to the billet tension controller 5, said controller comprising a swinging arm 27 with a counterbalance 28 on one end and a roller 29 on the other. The use of the arm with the counterbalance provides a constant tension of the tubular billet at the die entrance and the matching of the exit velocity of a tubular billet running from the billet-storage device and of its entrance velocity when it is reeled on the draw block. Moreover, a pivot 30 of the arm 27 is coupled with a velocity matching transmitter of the draw block and eccentric shaft (not shown in the drawing).

After that the pusher 6 threads-up and pushes the front end of the billet 2 through the die 8 until it approaches the draw block 9.

Following that, the billet end is caught by a gripper (not shown in the drawing) connected to the draw block, and the latter is brought into rotation.

As the front end of the billet advances, the block 13 (FIG. 3) of the billet-storage device 4 starts rotating.

The larger diameter block 15 is brought into rotation since it is connected to the smaller diameter block 13 through the billet 2. As the block 15 is running, the billet 2 is being transferred from the floor reel 1 onto that block.

The billet turns reeled on the larger diameter block 15 are drawn through the roller guide 25 which directs the billet to the smaller diameter block 13 and further to draw blocks. At that time both blocks are running freely about their spindles due to the billet tension force. The eccentric shaft 17 is then braked.

When the rear end of the billet approaches the butt-welding machine 3, the larger diameter block 15 is braked by means of the brake 26; the rear end of the billet 2 is stopped and the eccentric shaft 17 is set to run in a direction opposite to that in which it was running thus, ensuring the accumulation of the billet turns on the larger diameter block 15.

Then the smaller diameter block 13 starts running about the spindle of the larger diameter block 15 drawing the billet turns reeled thereon to be handled for further drawing.

Owing to the different diameters of the blocks 13 and 15 each revolution of the eccentric shaft 17 results in adding to a draw block of a billet section an amount equal to the difference in the lengths of circumferences of the blocks 13 and 15. Hence, the amounts of turns of the billet 2 on the smaller diameter block 13 is accumulated.

Joining completed, the brake acting on the larger diameter block 15 is released and the eccentric shaft is reversed by reversing the electric motor 22. As a result, the transfer of the turns from the larger diameter block 15 is stopped and the drawing process continues on account of the build-up on the smaller diameter block 13 stored when the billet ends had been joined by butt welding. During that period the billet turns are accumulated on the larger diameter block 15 to make up for the removal of turns unreeled from that block during the abutting operation.

As soon as all the turns collected on the smaller diameter block 13 during the abutting operation are removed therefrom, the eccentric shaft 17 is braked and the drawing process is carried out as outlined above.

Industrial tests of the proposed billet-storage device have demonstrated its dependability and operability in producing tubes by the reeling technique.

What we claim is:

1. A billet-storage device for a drawbench, which avoids twisting the billet during operation, comprising: two blocks of different diameters having parallel axes mounted on a housing with an eccentricity and adopted for reeling the billet thereon and for unreeling it therefrom, said blocks having their bases disposed at right angles to their axes and having a possibility of running freely, the smaller diameter block being mounted rotatably about the axis of said larger diameter block, so as to be able to rotate in both directions, the displacement of the axes of said blocks being equal to half the difference between the diameters of the bases of said blocks; and a device for directing the billet during its transfer from said larger diameter block to said smaller diameter block, said device being made as a roller guide arranged intermediate of said blocks; as a result, during the rotation of said smaller diameter block about the axis of said larger diameter block, which takes places when the billets are joined and welded end to end, and with said blocks placed in any relative position, the peripheral points on the bases of said blocks are located on coinciding generatrices of the block surfaces, thus enabling a stepless transfer of the tubular billet from said larger diameter block to said smaller diameter block.

2. A billet-storage device according to claim 1, wherein to enable said smaller diameter block to rotate about the axis of the larger diameter block a drive eccentric shaft is mounted inside each of said blocks, thereby providing each block with a possibility of running about the shafts.

* * * * *